United States Patent [19]

Stuckey

[11] Patent Number: 5,029,924

[45] Date of Patent: Jul. 9, 1991

[54] WELL PIPE EXTRACTOR APPARATUS

[76] Inventor: George H. Stuckey, 112 Washington St., Wauseon, Ohio 43567

[21] Appl. No.: 512,335

[22] Filed: Apr. 23, 1990

[51] Int. Cl.[5] ..... B66C 1/54; E21B 31/20

[52] U.S. Cl. ..... 294/86.12; 294/86.25; 294/96

[58] Field of Search ..... 294/86.1, 86.12, 86.14, 294/86.24–86.26, 93, 94, 96, 102.1, 102.2; 24/115 M, 136 R, 136 L

[56] References Cited

U.S. PATENT DOCUMENTS

| | | | |
|---|---|---|---|
| 818,928 | 4/1906 | Walker | 294/86.14 |
| 1,259,640 | 3/1918 | Leake | 294/86.25 |
| 1,474,886 | 11/1923 | Boyce | 294/96 X |
| 1,529,081 | 3/1925 | Nixon | 294/86.25 X |
| 1,721,021 | 7/1929 | Hinderliter | 294/96 X |
| 1,897,561 | 2/1933 | Manucci et al. | 294/94 |
| 2,594,429 | 4/1952 | Handley | 294/96 |
| 2,624,610 | 1/1953 | Murphy | 294/96 |
| 3,492,032 | 1/1970 | Deike | 294/94 X |
| 3,709,546 | 1/1973 | Vaughan | 294/96 |

FOREIGN PATENT DOCUMENTS

| | | | |
|---|---|---|---|
| 495040 | 8/1950 | Belgium | 294/96 |
| 1172860 | 8/1985 | U.S.S.R. | 294/96 |

*Primary Examiner*—Johnny D. Cherry
*Attorney, Agent, or Firm*—Leon Gilden

[57] ABSTRACT

An apparatus for removal of tubular pipe members, and particularly PVC pipe, from in-ground securement is provided. The apparatus includes an inverted sleeve for surrounding the pipe, with an engagement plug mounted within the pipe to capture the pipe between the engagement plug and the sleeve. An expander plug is directed interiorly of the engagement plug to expand the engagement plug to accordingly grasp the pipe for removal.

1 Claim, 4 Drawing Sheets

PRIOR ART 10
11
12
13
14
15
16
17
18
19
20
21
22
22
22
23
24
25
26
27
28
29
30

FIG 8
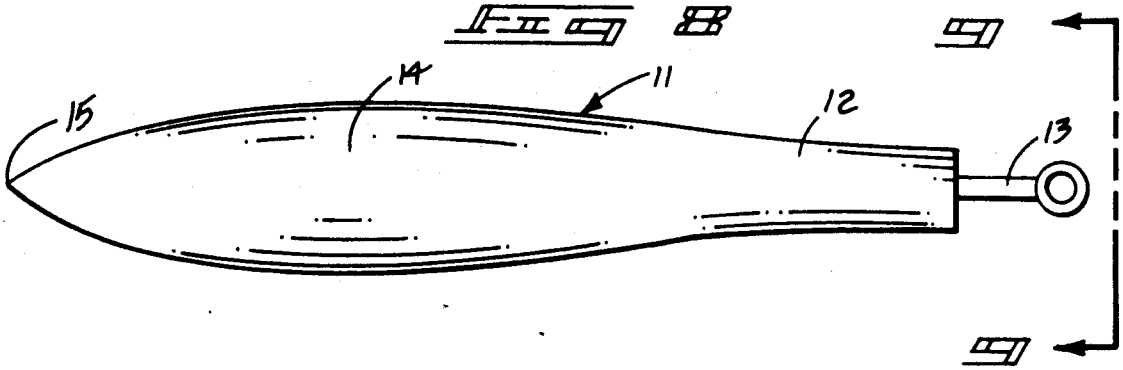
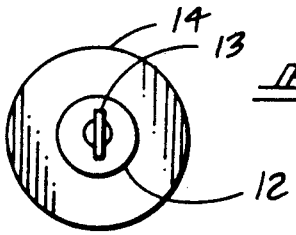
FIG 9
FIG 10
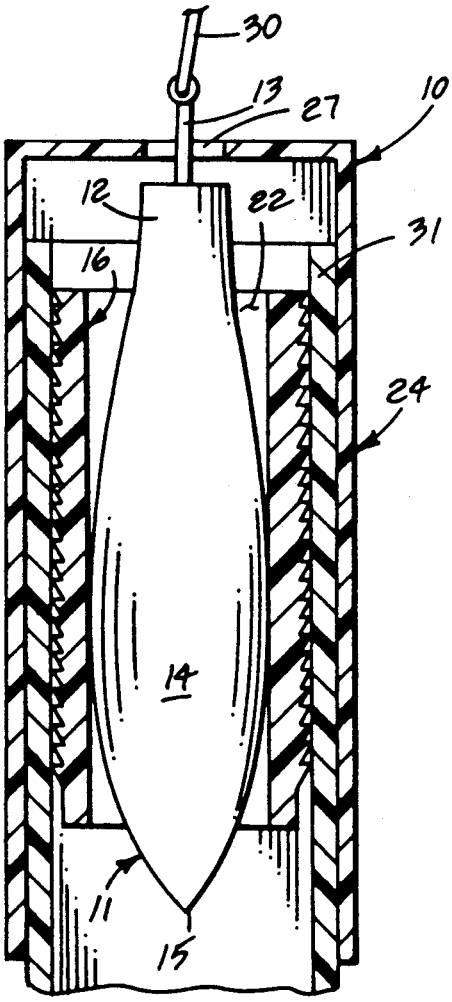

WELL PIPE EXTRACTOR APPARATUS

BACKGROUND OF THE INVENTION

1. Field of the Invention

The field of invention relates to pipe extractor apparatus, and more particularly pertains to a new and improved well pipe extractor apparatus wherein the same is provided to secure a well pipe and extract the same from in-ground placement.

2. Description of the Prior Art

Removal of well pipe, and particularly well pipe formed of relatively brittle PVC pipe, is in the prior art a relatively delicate operation as undue torquing of such pipe results in weakening and potential fracture of such pipe resulting in enhanced cost and time in removal of such well pipe. To merely frictionally engage an interior surface of such pipe results frequently in fracture due to the nature of the pipe in attempting to secure the pipe for extraction. The instant invention attempts to overcome deficiencies of the prior art by capturing the pipe between opposed cooperative surfaces to engage and effect removal of the pipe. Examples of prior art pipe apparatus may be found in U.S. Pat. No. 4,483,563 to Huiden wherein an elongate member defined by an outer sleeve relative to an internal cylindrical member is relatively positionable interiorly of a pipe for handling of such pipe members.

U.S. Pat. No. 3,912,320 to Keenan, as well as U.S. Pat. No. 3,029,098 to Sonnier; U.S. Pat. No. 4,537,435 to Carver; and U.S. Pat. No. 3,895,387 to Barnes set forth various members positionable interiorly of well pipes for retrieval of various lines within the pipe and are of interest relative to the structure utilized for directing structural components interiorly of pipe members.

As such, it may be appreciated that there continues to be a need for a new and improved well pipe extractor apparatus wherein the same addresses both the problems of ease of use as well as effectiveness in construction to surroundingly engage and permit extraction of a well pipe from an in-ground placement and as such, the present invention substantially fulfills this need.

SUMMARY OF THE INVENTION

In view of the foregoing disadvantages inherent in the known types of pipe extractor apparatus now present in the prior art, the present invention provides a well pipe extractor apparatus wherein the same permits securement and surrounding internal and external engagement of a pipe for removal of such pipe from an in-ground placement. As such, the general purpose of the present invention, which will be described subsequently in greater detail, is to provide a new and improved well pipe extractor apparatus which has all the advantages of the prior art pipe extractor apparatus and none of the disadvantages.

To attain this, the present invention provides an apparatus for removal of tubular pipe members, and particularly PVC pipe, from in-ground securement. The apparatus includes an inverted sleeve for surrounding the pipe, with an engagement plug mounted within the pipe to capture the pipe between the engagement plug and the sleeve. An expander plug is directed interiorly of the engagement plug to expand the engagement plug to accordingly grasp the pipe for removal.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved well pipe extractor apparatus which has all the advantages of the prior art pipe extractor apparatus and none of the disadvantages.

It is another object of the present invention to provide a new and improved well pipe extractor apparatus which may be easily and efficiently manufactured and marketed.

It is a further object of the present invention to provide a new and improved well pipe extractor apparatus which is of a durable and reliable construction.

An even further object of the present invention is to provide a new and improved well pipe extractor apparatus which is susceptible of a low cost of manufacture with regard to both materials and labor, and which accordingly is then susceptible of low prices of sale to the consuming public, thereby making such well pipe extractor apparatus economically available to the buying public.

Still yet another object of the present invention is to provide a new and improved well pipe extractor apparatus which provides in the apparatuses and methods of the prior art some of the advantages thereof, while simultaneously overcoming some of the disadvantages normally associated therewith.

Still another object of the present invention is to provide a new and improved well pipe extractor apparatus wherein the same is readily positionable interiorly and exteriorly of a pipe surface to engage a pipe surface for extraction thereof for an in-ground placement of the pipe.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an orthographic side view, taken in elevation, of the expander plug utilized by the instant invention.

FIG. 9 is an orthographic top view of the expander plug, as illustrated in FIG. 8.

FIG. 10 is an orthographic cross-sectional view of the instant invention in association with a well pipe to be extracted.

DESCRIPTION OF THE PREFERRED EMBODIMENT

Figure 1:
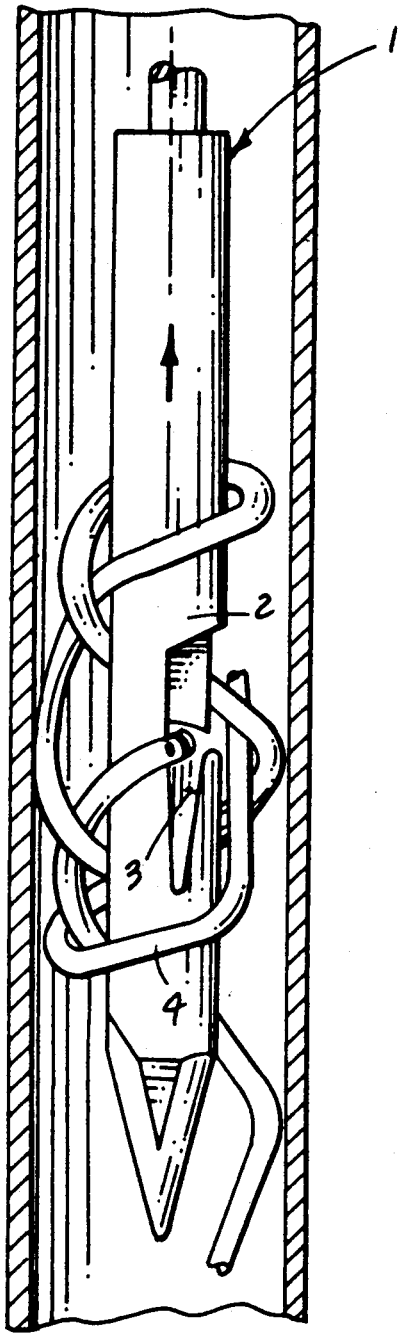
FIG. 1 is an orthographic cross-sectional view, taken in elevation, of a prior art pipe tool.

With reference now to the drawings, and in particular to FIGS. 1 to 10 thereof, a new and improved well pipe extractor apparatus embodying the principles and concepts of the present invention and generally designated by the reference numeral 10 will be described.

Figure 2:
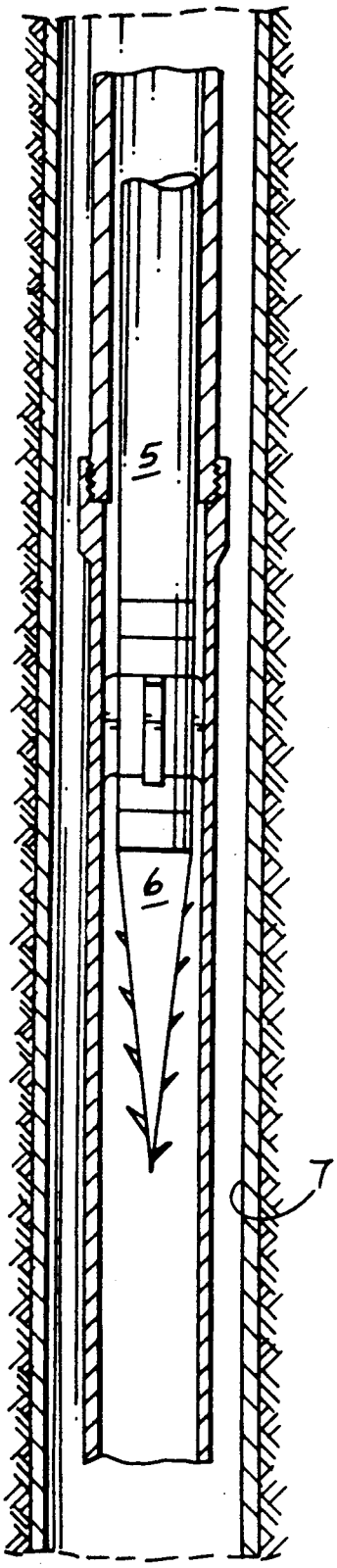
PRIOR ART Fig 2
FIG. 2 is a further cross-sectional illustration of a prior art pipe tool.
Figure 3:
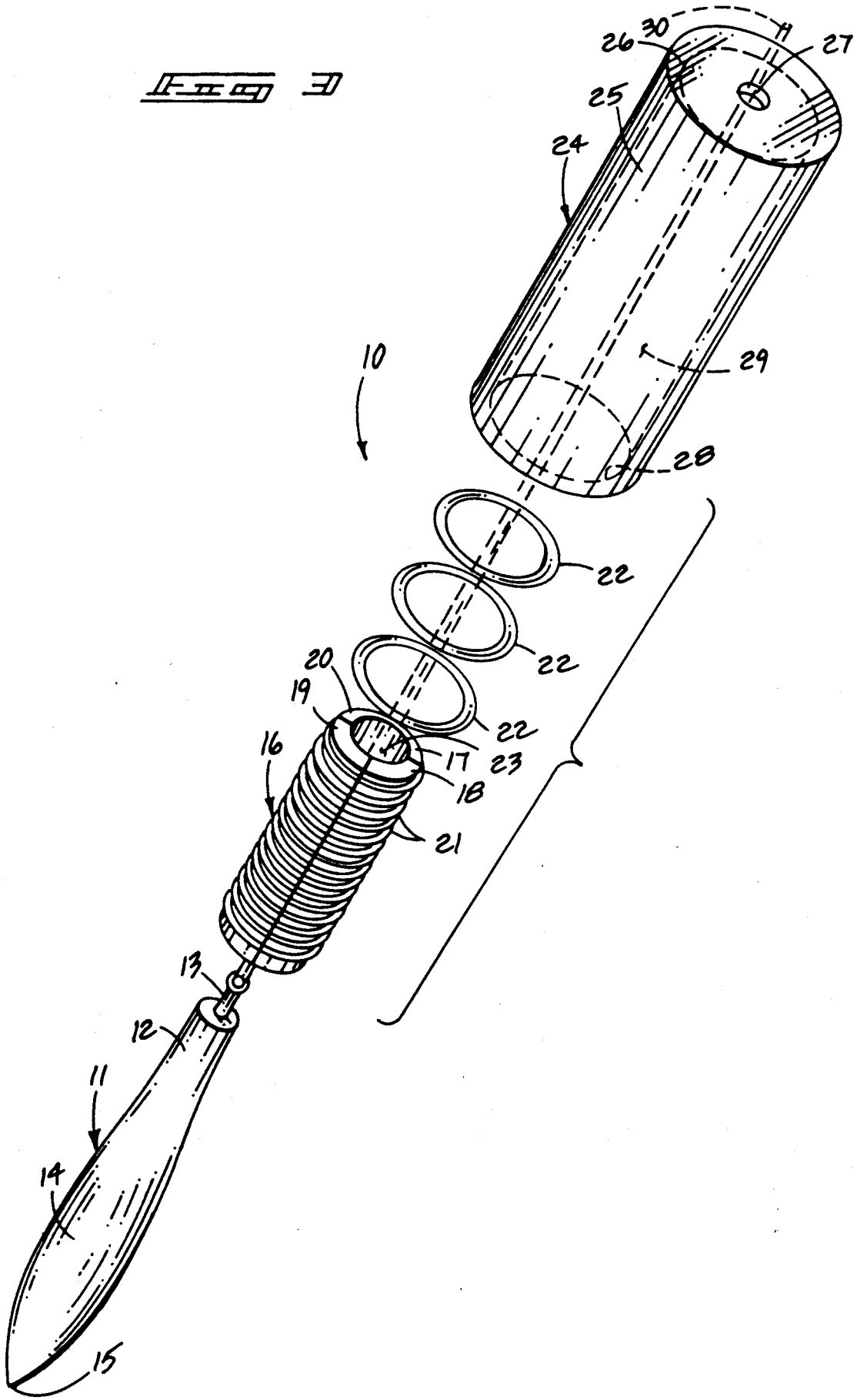
FIG. 3 is an isometric exploded illustration of the instant invention illustrating the various components, their parts, and relationship.
Figure 5:
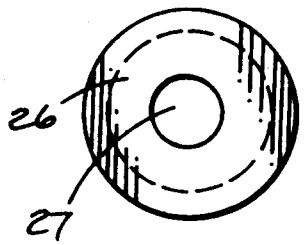
FIG. 5 is an orthographic view, taken along the lines 5—5 of FIG. 4, in the direction indicated by the arrows.
Figure 4:
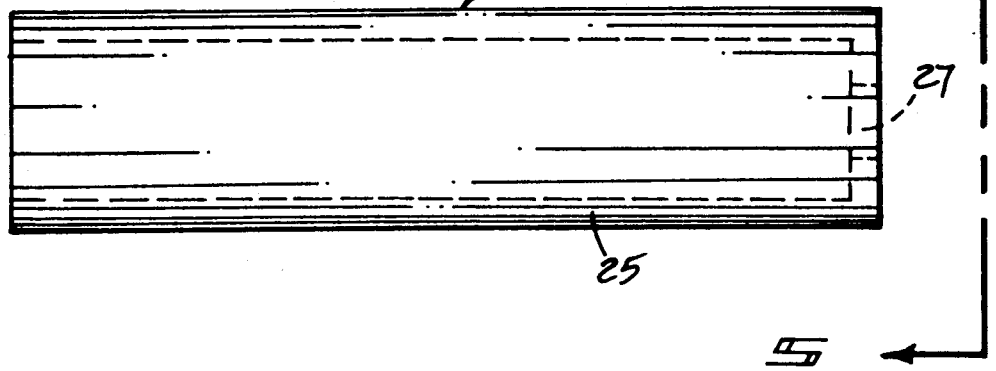
FIG. 4 is an orthographic side view, taken in elevation, of the sleeve utilized by the instant invention.
Figure 7:
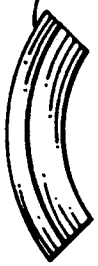
FIG. 7 is an orthographic view, taken along the lines 7—7 of FIG. 6, in the direction indicated by the arrows.
Figure 6:
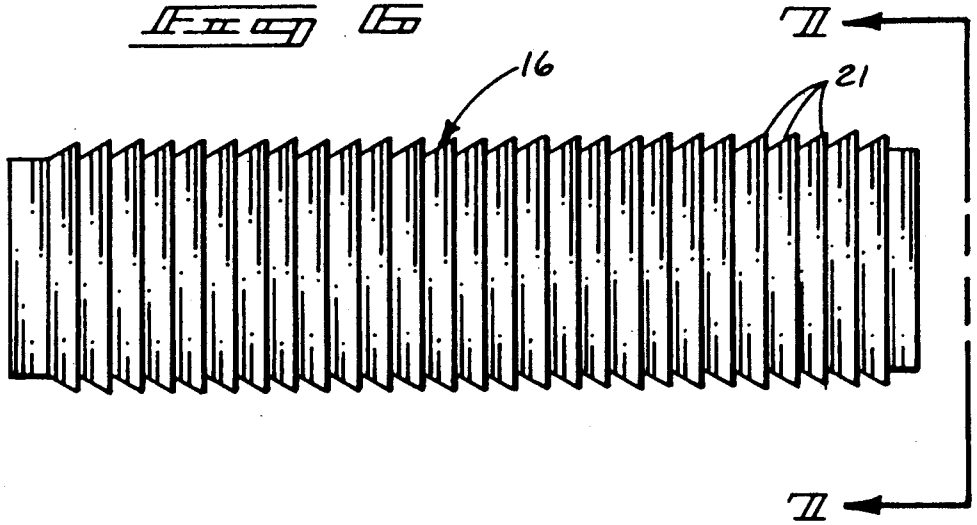
FIG. 6 is an orthographic view, taken in elevation, of a quarter cylindrical section of the engagement plug utilized by the instant invention.

FIG. 1 illustrates a prior art well tool 1 comprising a central body 2, including a slot 3 to secure a wire member 4 remaining within a tubular well pipe. FIG. 2 illustrates a further prior art well tool, including a central shank 5, with a lower head 6, including a matrix of projections thereon to retrieve flexible line from interiorly of a well pipe 7.

More specifically, the well pipe extractor apparatus 10 of the instant invention essentially comprises an expander plug 11 defined by a rear coaxially aligned cylindrical shank 12 tapering downwardly to an conical forward end 14, with the conical forward end including a major axis coaxially aligned with the shank 12, and a minor axis defining a minor axis diameter. A loop connector 13 is rearwardly and coaxially directed from the rear end of the shank 12, as illustrated, for securement of a flexible cable member 30, as illustrated in FIG. 10 thereto. A pointed forward tip 15 defining a forwardmost extent of the major axis of the conical forward end 14 permits enhanced positioning of the expander plug 11 within the organization. The expander plug 11 is directed rearwardly to be received within an engagement plug 16 that in turn is positioned within an associated tubular well pipe 31, as illustrated in FIG. 10. The engagement plug 16 is defined by an external plug diameter and includes a first, second, third, and fourth respective quarter cylindrical rib section 17, 18, 19, and 20. Each ribbed section includes a series of downwardly tapered conical ribs 21 equally spaced along the exterior surface defined by the engagement plug 16. The engagement plug is further defined by a coaxially aligned cylindrical plug bore 23 defined by a predetermined bore diameter. The bore diameter of the cylindrical plug bore 23 is less than that defined by the minor axis diameter of the conical forward end 14. The ribbed sections 17–20 are secured together by a plurality of annular spring rings 22 formed of polymeric or metallic construction to permit selective expansion of the rib sections relative to one another when the expander plug 11 is received interiorly of the cylindrical plug bore 23.

An inverted sleeve 24 is defined by a cylindrical body 25, with a planar top end 26 including a top end aperture 27 directed medially thereof coaxially aligned with the cylindrical body 25. The sleeve 24 further defines an opened lower end 28 providing entry into a cylindrical cavity 29. The inverted sleeve 24 includes an internal sleeve diameter formed within the cylindrical cavity substantially equal to the external diameter of the engagement plug 16, plus the thickness of the tubular well pipe 31 defined between an internal pipe diameter and an external pipe diameter defined by the tubular pipe 31.

In use, the expander plut 11 is directed interiorly of the associated tubular pipe 31, whereupon the engagement plug 16 is positioned within the tubular pipe and the inverted sleeve 24 positioned in a surrounding relationship exteriorly of the tubular pipe. Upon directing of the expander plug 11 interiorly of the engagement plug 16, the conical ribs 21 of the engagement plug 16 engage the interior surface of the tubular pipe 31, while the integrity of the tubular pipe is maintained by the internal surface of the inverted sleeve 24 to permit extraction of the well pipe upon lifting or drawing of the flexible cable member 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A well pipe extractor apparatus for securement to a pipe, wherein the apparatus comprises, an inverted cup-shaped sleeve, the sleeve including a sleeve aperture directed through a top end of the sleeve, and an opened sleeve end defining a lower opening end of the sleeve, wherein the opened sleeve end defines a cylindrical cavity defined by an internal sleeve diameter substantially equal to the external pipe diameter, and an engagement plug receivable within the pipe and the sleeve and expandably mounted interiorly of the sleeve, the engagement plug including a cylindrical plug bore coaxially directed through the engagement plug, the cylindrical plug bore defined by a predetermined bore diameter, and an expander plug receivable within the cylindrical plug bore, wherein the expander plug includes an external plug diameter greater than the cylindrical plug bore, and wherein the expander plug includes a coaxially aligned shank, the shank directed downwardly relative to the sleeve aperture to include a conical forward end, the conical forward end including a major axis coaxially aligned with the shank and a forward pointed tip, and the shank including a coaxially directed loop connector, the loop connector including a flexible cable member mounted thereto, wherein the flexible cable member is directed through the aperture of the sleeve, and wherein the engagment plug includes a first, second, third, and fourth quarter cylindrical ribbed section defining the engagement plug, and wherein the first, second, third, and fourth ribbed sections are of equal configuration, and wherein the ribbed sections include engagement ribs on an exterior surface of each ribbed section of the engagement plug and the engagement ribs are defined by downwardly tapered conical ribs, and each quarter ribbed section defines one-fourth of each of said conical ribs, and including a series of annular spring rings mounted exteriorly of the engagement plug to secure the first, second, third, and fourth ribbed sections together, and wherein the loop connector directed rearwardly of the shank projects exteriorly through the aperture of the sleeve when the expander plug is directed into the engagement plug, and wherein the sleeve aperture is formed through a planar top end integrally and orthogonally mounted to a top terminal end of the cylindrical body, wherein the planar top end is orthogonally aligned relative to an axis defined by the cylindrical body, and the aperture, the cylindrical body, the shank, the conical forward end, and the engagement plug are coaxially aligned relative to one another and wherein the pipe is receivable between the engagement plug and the sleeve.

* * * * *